US009289818B2

(12) United States Patent
Skolaude

(10) Patent No.: US 9,289,818 B2
(45) Date of Patent: Mar. 22, 2016

(54) DEVICE AND METHOD FOR REVERSIBLY GRIPPING A BOLT-SHAPED ELEMENT, IN PARTICULAR A RIVET MANDREL

(71) Applicant: Richard Bergner Verbindungstechnik GMBH & Co. KG, Schwabach (DE)

(72) Inventor: Andreas Skolaude, Schwabach (DE)

(73) Assignee: Richard Bergner Verbindungstechnik GmbH & Co. KG, Schwabach (DE)

( * ) Notice: Subject to any disclaimer, the term of this patent is extended or adjusted under 35 U.S.C. 154(b) by 228 days.

(21) Appl. No.: 13/957,762

(22) Filed: Aug. 2, 2013

(65) Prior Publication Data

US 2014/0033510 A1 Feb. 6, 2014

(30) Foreign Application Priority Data

Aug. 2, 2012 (DE) ..... 10 2012 213 737

(51) Int. Cl.
*B21J 15/32* (2006.01)
*B21J 15/04* (2006.01)
*B21J 15/30* (2006.01)

(52) U.S. Cl.
CPC ..... *B21J 15/32* (2013.01); *B21J 15/043* (2013.01); *B21J 15/30* (2013.01); *Y10T 29/49* (2015.01); *Y10T 29/49943* (2015.01); *Y10T 29/49954* (2015.01); *Y10T 29/49956* (2015.01); *Y10T 29/5327* (2015.01); *Y10T 29/53383* (2015.01); *Y10T 29/53422* (2015.01); *Y10T 29/53774* (2015.01); *Y10T 29/53991* (2015.01)

(58) Field of Classification Search
CPC ..... B21J 15/32; B21J 15/043; B21J 15/30; Y10T 29/53383; Y10T 29/53422; Y10T 29/49954; Y10T 29/5327; Y10T 29/49956; Y10T 29/49943; Y10T 29/53774; Y10T 29/49; Y10T 29/53991
See application file for complete search history.

(56) References Cited

U.S. PATENT DOCUMENTS 3,362,211 A * 1/1968 Chirco ..... 29/243.522
6,834,420 B1 * 12/2004 Rothe et al. ..... 29/243.526

FOREIGN PATENT DOCUMENTS

DE 10029392 B4 12/2004

* cited by examiner

*Primary Examiner* — John C Hong
(74) *Attorney, Agent, or Firm* — Laurence A. Greenberg; Werner E. Stemer; Ralph E. Locher

(57) ABSTRACT

The device for reversibly gripping a rivet mandrel has a tension head with a mouthpiece sleeve and a clamping jaw sleeve axially movable in the mouthpiece sleeve and accommodating a plurality of clamping jaws. The clamping jaws reversibly grip the rivet mandrel during an axial displacement of the clamping jaw sleeve and the clamping jaws are furthermore held by an elastic holding element. The jaws are displaceable relative to one another independently of an actuation by the clamping jaw sleeve. This enables improved introduction and gripping of the rivet mandrel, especially for fully automated blind rivet operations, for example with blind rivet robots. Due to the elastic holding of the clamping jaws, wear on one side of the clamping jaws is avoided. Also, a controlled displacement of the clamping jaws independently of the clamping jaw sleeve is provided.

20 Claims, 4 Drawing Sheets

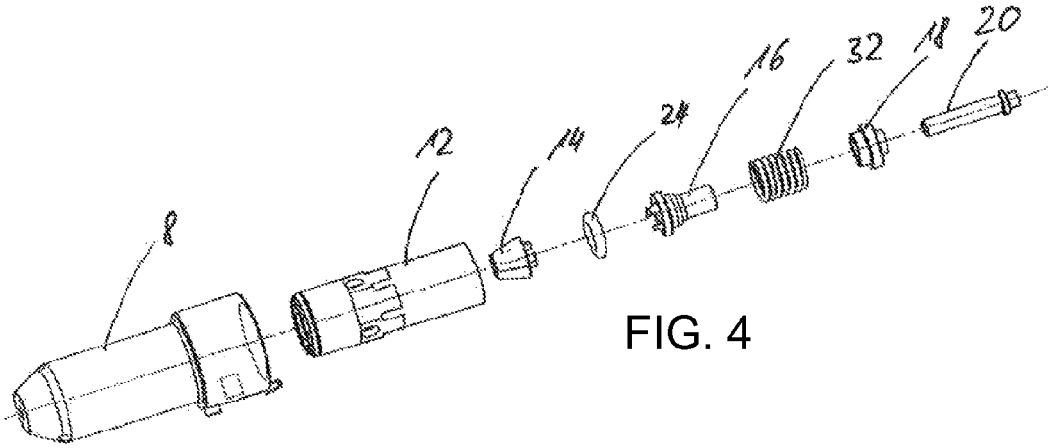
FIG. 4
FIG. 5
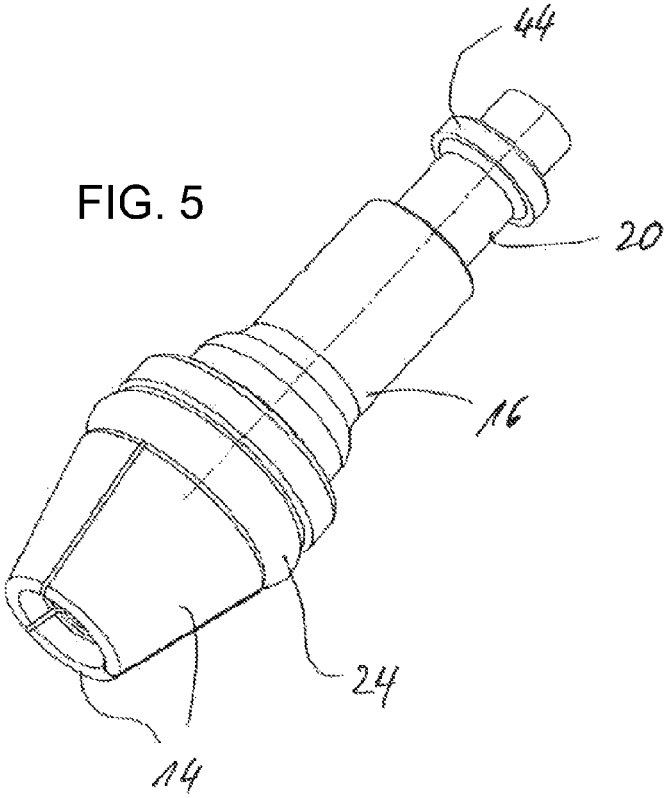

DEVICE AND METHOD FOR REVERSIBLY GRIPPING A BOLT-SHAPED ELEMENT, IN PARTICULAR A RIVET MANDREL

CROSS-REFERENCE TO RELATED APPLICATION

This application claims the priority, under 35 U.S.C. §119, of German application DE 10 2012 213 737.8, filed Aug. 2, 2012; the prior application is herewith incorporated by reference in its entirety.

BACKGROUND OF THE INVENTION

1. Field of the Invention

The invention relates to a device for reversibly gripping a bolt-shaped element, in particular a rivet mandrel of a blind rivet. The invention furthermore relates to a method for reversibly gripping such a bolt-shaped element. The device has a tension head which extends in an axial direction and has a mouthpiece sleeve, a clamping jaw sleeve which is movable in the axial direction in the mouthpiece sleeve, and a plurality of segmented clamping jaws each extending in the axial direction from a front end to a rear end. The clamping jaws form between one another a receiving space for receiving the bolt-shaped element, are arranged within the clamping jaw sleeve, and are formed such that they are displaced in a radial direction in order to reversibly grip the bolt-shaped element in the event of an axial movement of the clamping jaw sleeve.

A device of the generic type is described in German patent No. DE 100 29 392 B4.

When a blind rivet is set into a component, the blind rivet is introduced with a blind rivet sleeve into the pre-punched component until it comes to rest against the component by way of a setting head. A rivet mandrel is guided through the rivet sleeve, the rivet mandrel bearing on one side against the end sleeve by way of a mandrel head. During the setting operation, the rivet mandrel is gripped with the aid of a setting device and is pulled in an axial direction such that a closing head is formed opposite the setting head and the blind rivet is fixedly connected to the component.

During this setting operation, reliable gripping and pulling of the rivet mandrel in the axial direction is necessary. When a desired setting force is reached, the rivet mandrel breaks off.

For a high-quality blind rivet connection, exact and defined gripping of the rivet mandrel is necessary. This applies in particular to automated blind rivet setting methods, for example in production lines in which the blind rivets are set in a fully automated manner with the aid of blind rivet robots. Such blind rivet robots are increasingly used nowadays, for example in the motor vehicle industry during car body manufacturing.

For gripping and pulling, generally—also according to the German patent DE 100 29 392 B4—so-called tension heads are known which extend in the axial direction and have a mouthpiece sleeve by way of which the tension head is supported on the component surface during the setting operation. Arranged within the mouthpiece sleeve is a clamping jaw sleeve which is arranged so as to be movable in the axial direction in the mouthpiece sleeve. The clamping jaw sleeve narrows in this case at its front end side in a wedge-like or conical manner and receives, in this front part region, clamping jaws which are formed in a correspondingly conical or wedge-like manner and are designed to receive the rivet mandrel. Via a drive of the setting appliance, for example a hydraulic drive or an electric drive, the clamping jaw sleeve is displaced toward the rear in the axial direction during the setting operation, such that the clamping jaws, on account of the conical configuration, are displaced radially inward and grip the rivet mandrel, previously introduced through a mouthpiece, in a clamping manner and subsequently pull the rivet mandrel toward the rear in the axial direction until the required setting force has been reached and the rivet mandrel breaks off.

In the (fully) automated setting process, it is necessary for the respective residual mandrel to be received automatically in the tension head, for automatic movement to the desired setting position to take place and subsequently also for the broken-off residual mandrel to be automatically removed in a technically reliable manner. During gripping, it is possible in particular for problems to occur in this case when the rivet mandrel is not oriented exactly axially parallel with a center axis of the tension head. The rivet mandrel is in that case not accommodated concentrically within the clamping jaws, and as a result, during the subsequent pulling-back process, the clamping jaws clamp the rivet mandrel only at different axial positions and this can result in an axial offset of the clamping jaws. This generally results in a nonuniform distribution of tensile force in the clamping jaws, such that one part of the clamping jaws is subjected to greater loading than the other part, resulting in premature wear.

A further problem is the reliable disposal of the broken-off residual mandrel. In this case, there is sometimes the risk that the residual mandrel remains adhering to the clamping jaws after the setting operation has been completed and after the clamping jaws have been moved back into their front starting position. This is a considerable disadvantage in particular in fully automated methods, since the production process then has to be interrupted.

In such automated operations, furthermore, the automated gripping of the blind rivet also represents a certain problem since the rivet mandrel of the blind rivet has to be introduced into the clamping jaws with the latter open. In order to prevent the rivet mandrel from slipping and falling out, the latter has to be held in the mouthpiece sleeve via a special measure until the clamping jaws exert a certain clamping force on the rivet mandrel in order to secure the latter against falling out before the setting appliance moves the blind rivet to the designated position and inserts it into the pre-punched component.

SUMMARY OF THE INVENTION

Against this background, it is accordingly an object of the invention to provide a process and a device which overcome the above-mentioned disadvantages of the heretofore-known devices and methods of this general type and which provides for an improved device for reversibly gripping a bolt-shaped element, in particular a rivet mandrel of a blind rivet, which is suitable in particular for fully automated rivet setting operations.

With the foregoing and other objects in view there is provided, in accordance with the invention, a device for reversibly gripping a bolt-shaped element with a tension head extending in an axial direction, comprising:

a mouthpiece sleeve;

a clamping jaw sleeve movably mounted in the mouthpiece sleeve along the axial direction;

a plurality of segmented clamping jaws each extending in the axial direction from a front end to a rear end thereof, wherein the clamping jaws:

define a receiving space between one another for receiving the bolt-shaped element;

are disposed within the clamping jaw sleeve;

are configured to be displaced in a radial direction in order to reversibly grip the bolt-shaped element on occasion of an axial movement of the clamping jaw sleeve;

are displaceable with respect to one another independently of an actuation via the clamping jaw sleeve; and are furthermore held by an elastic holding element.

In other words, the objects of the invention are achieved by a device for reversibly gripping a bolt-shaped (i.e., pin-shaped, pin) element, in particular a rivet mandrel, as claimed, and by a method for reversibly gripping a bolt-shaped element with the aid of such a device. The novel device comprises a tension head extending in an axial direction and having a mouthpiece sleeve, a clamping jaw sleeve which is displaceable therein in the axial direction, and also segment-like clamping jaws arranged therein. These define between one another a receiving space for receiving the bolt-shaped element. The tension head is now formed such that the clamping jaws are held against one another via an elastic holding element specifically such that the clamping jaws are displaceable with respect to one another independently of an actuation via the clamping jaw sleeve.

On account of the elastic, reciprocal holding of the clamping jaws against one another, in the case of the rivet mandrel being introduced off-center into the receiving space between the clamping jaws, self-centering of the clamping jaws is automatically achieved, since the latter are coupled together via the elastic holding element. This ensures that, during subsequent clamping via the clamping jaw sleeve, the individual clamping jaws are moved uniformly against the rivet mandrel and as a result the clamping jaws are also subjected to uniform loading. As a result, premature selective wear of individual clamping jaws is avoided. The term "displaceable" is therefore understood as meaning that each clamping jaw can be displaced in the radial direction toward or away from a center longitudinal axis, specifically without a radial force being exerted on the clamping jaws by the clamping jaw sleeve. On account of the connection of the clamping jaws via the elastic holding element, the latter can therefore generally be reciprocally spread apart from one another in an articulated manner, and therefore are as a whole connected together in an articulated manner.

According to an expedient development, a first stroke range of the clamping jaw sleeve is formed, in which the latter is in the open position. The open position of the clamping jaw sleeve is understood to mean an axial position in which it exerts no clamping force on the clamping jaws, that is to say is usually radially spaced apart somewhat therefrom. The tension head is therefore generally formed such that it can additionally actuate the clamping jaws in the open position of the clamping jaw sleeve. Within this open position or within this stroke range or else at a defined stroke position of the clamping jaw sleeve, the clamping jaws are transferable from a fixing position into a releasing position preferably with the aid of at least one first control element. In this case, the fixing position serves preferably for holding the rivet mandrel in the receiving space before the entire rivet mandrel is gripped in a clamping manner by the clamping jaw sleeve being set back axially. Therefore, in this fixing position—although the clamping jaw sleeve is still in its open position—the blind rivet is held reliably in the tension head. This allows the blind rivet to be received in a reliable manner.

By contrast, in the releasing position, the clamping jaws are spread in a specific manner by the control element such that no clamping force is exerted on the rivet mandrel. This releasing position serves for safely removing the residual mandrel after the setting operation has been completed. In the fixing position, the rivet mandrel is in this case expediently held purely passively on account of the elastic holding force of the holding element, which is thus formed such that the clamping jaws are pulled radially inward toward one another. Therefore, in this fixing position, the clamping jaws are arranged sufficiently close to one another, at least in part regions, to clamp the rivet mandrel. On account of the elasticity, easy introduction is at the same time enabled such that, when the rivet mandrel is introduced, the clamping jaws are expanded somewhat. Therefore, in the fixing position, the clamping jaws at least regionally define a receiving region having a smaller diameter compared to the diameter of the rivet mandrel. Therefore, for the purpose of transferring from the fixing position into the releasing position, the control element acts actively against this elastic holding force and moves the clamping jaws outward in the radial direction.

Expediently, the clamping jaws are in this case oriented obliquely with regard to the axial direction in the fixing position, such that the receiving space is formed in a funnel-like manner. This allows easy introduction of the rivet mandrel into the receiving space. In the rear, narrowed part region, the receiving space then has the smaller diameter compared with the diameter of the rivet mandrel.

The clamping jaws are transferred between the fixing position and the releasing position by way of the first control element which is displaceable in the axial direction relative to the clamping jaws. Preferably, in the releasing position, the clamping jaws are expanded in relation to one another by the first control element at their rear end. Therefore, the first control element acts on the rear end of the clamping jaws and spreads the latter. As a result, in particular the funnel-like orientation of the clamping jaws in the fixing position is reversed.

To this end, the first control element preferably has an end-side cone by way of which it acts on the rear end of the clamping jaws in order to spread them apart. Alternatively or in addition, the rear end of the clamping jaws is in each case provided with a slope or an inner cone.

In a particularly preferred embodiment, the first control element is in this case coupled to the clamping jaw sleeve such that, in the event of an axial displacement of the clamping jaw sleeve in the axial direction, the first control element is forcibly carried along. Therefore, in order to actuate the first control element, no additional actuating device is necessary. Rather, this takes place automatically via the actuating movement of the clamping jaw sleeve which takes place anyway. This is usually associated with an actuating element of a drive unit via which the setting operation is controlled or regulated. Expediently, forced guidance of the first control element takes place during a movement toward the mouthpiece sleeve, that is to say when the clamping jaw sleeve is transferred from a clamping position, in which it exerts a radial clamping force on the clamping jaws, into the open position. The open position extends in this case over a certain stroke range. Therefore, as a result of the forced guidance of the control element, the fixing position and the releasing position are defined and fixed by discrete stroke positions of the clamping jaw sleeve within this stroke range. Therefore, when the clamping jaw sleeve is moved forward, a first stroke position is reached in which the fixing position is taken up. Finally, by way of a subsequent further displacement to a second, further forward stroke position, the releasing position is reached in which the first control element spreads apart the clamping jaws. The first control element is in this case preferably formed as a whole as a control sleeve which extends concentrically with the clamping jaw sleeve and along the center longitudinal axis.

The front end of the clamping jaws is expediently assigned a second control element which is likewise displaceable relative to the clamping jaws in the axial direction and which is designed to spread apart the clamping jaws at their front end. This ensures that the clamping jaws are also spread apart at their front end in spite of the elastic holding element, in particular in order to allow both an introduction of the rivet mandrel into the fixing position and reliable removal of the rivet mandrel after the setting operation has been completed.

In this case, the second control element is expediently formed as a stationary, preferably conical pin formed in particular on the mouthpiece sleeve. In the open position of the clamping jaw sleeve, in which the rivet mandrel can be received, the clamping jaws are usually pressed into a front position with the aid of a, for example spring-force-actuated, pressure piece. As a result, they are pressed against the second control element, as a result of which the front end is expanded.

This expanded position of the front end of the clamping jaws is in this case taken up expediently both in the releasing position and in the fixing position. As a result, the desired funnel-like receptacle is enabled in the fixing position and the reliable removal of the rivet mandrel is enabled in the releasing position.

In a preferred embodiment, the elastic holding element is arranged at the rear end of the clamping jaws, such that the latter are held against one another in a hinge-like manner at the rear end. The holding element generally defines a type of hinge joint for the clamping jaws such that the latter can be pivoted radially outward with respect to one another.

The holding element is in this case guided in particular in an annular manner around the clamping jaws. It is preferably in the form of an O-ring. Alternatively, it is also possible for the individual clamping jaws to be connected together for example by elastic material being vulcanized on.

As already mentioned, the clamping jaws are additionally pressed forward with the aid of a pressure sleeve. Expediently, the clamping jaws are fastened to this pressure sleeve via the elastic holding element. Direct coupling therefore takes place between the clamping jaw sleeve and pressure sleeve. This firstly makes assembly easier, since the usually loose wedge-like clamping jaws are held against the pressure sleeve via the holding element. Furthermore, impact decoupling is additionally achieved as a result in a particularly advantageous manner. Specifically, when the rivet mandrel breaks, considerable rebound forces occur. These are damped effectively by the elastic holding element. Thus, the entire system is decoupled from such sudden forces and this has a positive effect overall on the service life of the individual components, in particular on a drive.

In order to reciprocally fasten the clamping jaws on the pressure sleeve, these elements expediently have end-side holding lugs about which the holding element is placed. The holding lugs of the pressure sleeve and of the clamping jaws engage reciprocally in one another as seen in the axial direction, and therefore are located at the same axial height in the assembled position. In the circumferential direction, the holding lugs are in this case preferably at a distance from one another in order to allow the individual parts to be able to move with respect to one another.

Preferably, the clamping jaws are kept at a distance from the pressure piece by a damping travel. When the rivet mandrel breaks off during the setting operation, it is therefore possible for the clamping jaws—in a manner damped by the elastic holding element—initially to be displaced in the axial direction by the length of the damping travel relative to the pressure piece, before they butt against the latter.

The holding lugs furthermore preferably have a concave abutment surface for the holding element, in particular the O-ring, such that the latter rests as far as possible with a form fit against the holding lugs. Therefore, as seen in the axial direction, an at least partial form fit takes place between the holding lugs and the holding element, such that the two elements, pressure sleeve and clamping jaws, are held against one another in the axial direction.

Other features which are considered as characteristic for the invention are set forth in the appended claims.

Although the invention is illustrated and described herein as embodied in device and method for reversibly gripping a bolt-shaped element, in particular a rivet mandrel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 4 shows a perspective exploded illustration of the tension head;

FIG. 5 shows a preassembled subassembly, consisting of clamping jaws, elastic holding element, pressure sleeve and control sleeve;

DETAILED DESCRIPTION OF THE INVENTION

Figure 1A:
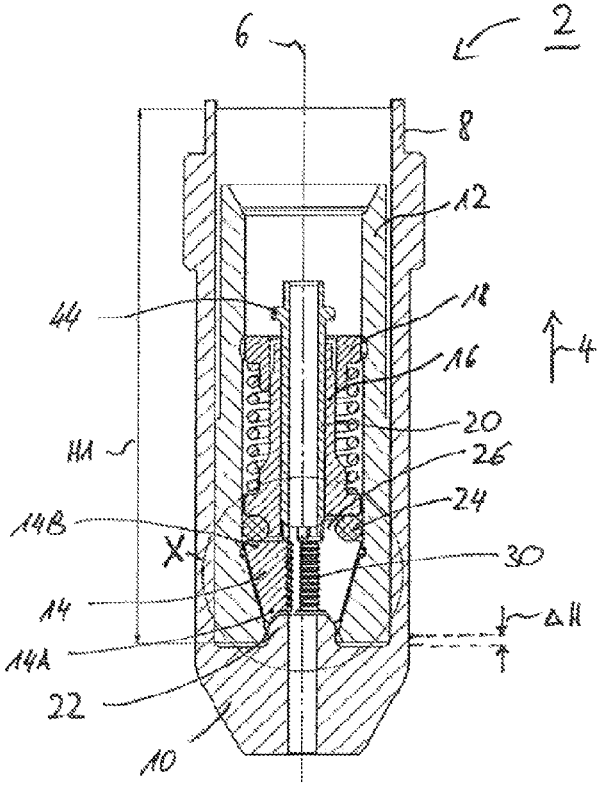
FIG. 1A shows a sectional view of a tension head, in which a clamping jaw sleeve is in a first, front stroke position in which the clamping jaw sleeve is in an open position and clamping jaws take up a releasing position.
Figure 1B:
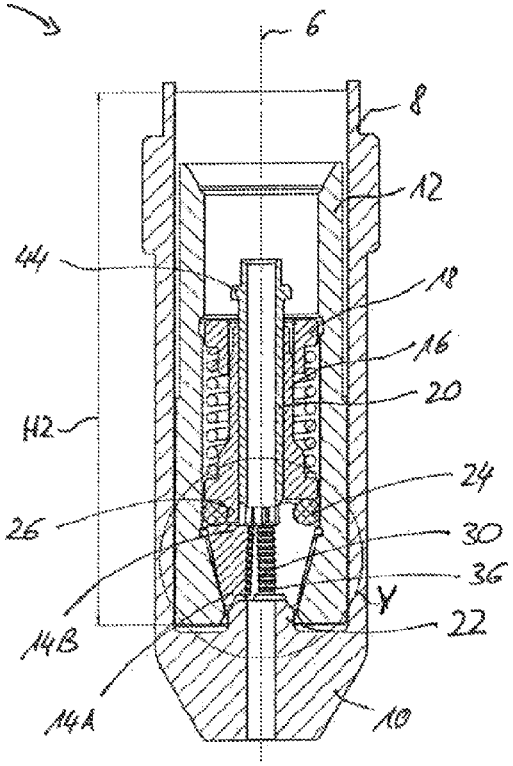
FIG. 1B shows a sectional view through the tension head similar to FIG. 1A, wherein the clamping jaw sleeve is in a second stroke position in the open position, in which the clamping jaws take up a fixing position.

Referring now to the figures of the drawing in detail in which same and functionally identical parts are identified with corresponding reference signs throughout, and first to FIGS. 1A and 1B thereof, there is shown tension head 2, illustrated in a sectional illustration. The tension head 2 extends in an axial direction 4 along a center axis 6. The tension head 2 has an outer mouthpiece sleeve 8 having an end-side mouthpiece 10. Within the mouthpiece sleeve 8, there is disposed a clamping jaw sleeve 12 in a slidable manner. In the end region oriented toward the mouthpiece 10, the clamping jaw sleeve 12 internally narrows in a conical manner. In this conically narrowing end region, the clamping jaw sleeve 12 accommodates clamping jaws 14 which extend in the axial direction 4 from a front end 14A to a rear end 14B. These are arranged in a segment-like manner around the center axis 6. In the exemplary embodiment, three clamping jaws 14 are arranged. The clamping jaws 14 are adjoined toward the rear in the axial direction 4 by a pressure sleeve 16 and a terminating cap 18. A control sleeve 20, which has an encircling annular stop 44 at its rear end, is guided as first control element through the pressure sleeve 16.

A second control element of the pin type 22 is formed on the mouthpiece 10 in the direction toward the clamping jaws 14. While radial spreading of the rear end 14A of the clamping jaws 14 takes place via the control sleeve 20, the pin 22 effects radial spreading of the front end 14B.

The clamping jaws 14 are held against one another and against the pressure sleeve 16 with the aid of an elastic holding element formed as an O-ring 24. To this end, holding lugs 26, which are surrounded in an encircling manner by the O-ring 24, are formed both on the clamping jaws 14 and on the pressure sleeve 16.

The clamping jaws 14 define a receiving space 30 that receives a rivet mandrel 28. In order to reliably grip the rivet mandrel 28, the clamping jaws 14 have clamping ribs 36 on their inner sides.

The tension head 2 is fastened to the front end of a blind rivet setting appliance. To this end, the mouthpiece sleeve 8 is fixed in a stationary manner to the setting appliance, for example is screwed thereon. The setting appliance comprises a drive for producing a linear actuating movement. The drive is in this case for example a hydraulic drive or an electric drive. Via the latter, a linear actuating element is displaced in order to exert the desired pulling movement. The linear actuating element is in this case firmly connected to the rear end of the clamping jaw sleeve 12, for example by a screw connection. The actuating element is in this case usually supported on the annular surface formed by the cap 18. At the same time, the annular stop 44 on the control sleeve 20 defines a stop for the actuating element. The control sleeve 20 is therefore carried along forcibly, and thus in a manner coupled to the clamping jaw sleeve 12, by the actuating element forward in the actuating direction in the direction of the mouthpiece 10.

During the setting operation, first of all a blind rivet having the rivet mandrel 28 is passed through the mouthpiece 10 into the receiving space 30. Subsequently, the actuating element is pulled toward the rear in the axial direction 4 via the drive. In this case, the clamping jaw sleeve 12 is displaced relative to the mouthpiece sleeve 8 and relative to the clamping jaws 14. The clamping jaws 14 are pressed forward in the direction of the mouthpiece 10 with the aid of the spring-loaded pressure sleeve 16. On account of the conical configuration of the clamping jaw sleeve 12 and of the clamping jaws 14, the latter are in the process displaced radially inward and grip the rivet mandrel 28 in a manner known per se. The rivet mandrel 28 is pulled further toward the rear until it breaks off. Subsequently, the actuating element moves in a controlled manner back into the open position again in order to release the remaining residual mandrel and in order to be able to receive a new blind rivet for the next setting operation.

On account of the special configuration and function, described in more detail in the following text, an additional controlled movement of the clamping jaws 14 in the open position of the clamping jaw sleeve 12 is enabled. The clamping jaws 14 can be displaced in the open position between a releasing position shown in FIGS. 1A, 2A and 3A and a fixing position illustrated in FIGS. 1B, 2B and 3B with the aid of the control sleeve 20. This takes place in that the clamping jaw sleeve 12 takes up two defined stroke positions, specifically a front stroke position H1 (cf. FIG. 1A) and a rear stroke position H2 (cf. FIG. 1 B) within a stroke range ΔH, in a controlled manner. Therefore, over the entire stroke range ΔH, the clamping jaw sleeve 12 and thus the entire tension head 2 are in the open position. In said position, an encircling gap is formed between the clamping jaws 14 and the inner cone of the clamping jaw sleeve 12, even with a received rivet mandrel 28.

Figure 2A:
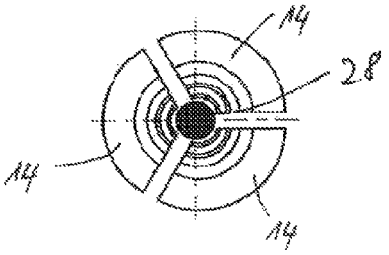
FIG. 2A shows a bottom end view of the tension head in the releasing position illustrated in FIG. 1A with an inserted rivet mandrel.
Figure 2B:
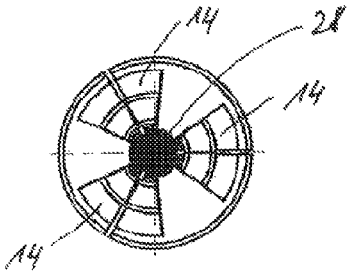
FIG. 2B shows an end view corresponding to FIG. 2A in the fixing position illustrated in FIG. 1B.

In the releasing position, the rivet mandrel 28 is completely released, as can be gathered from FIG. 2A. By contrast, in the fixing position, the rivet mandrel 28 is held in a force-fitting manner at the rear end 14A of the clamping jaws on account of a funnel-like arrangement of the clamping jaws 14, as can be seen in FIG. 2B.

Figure 3A:
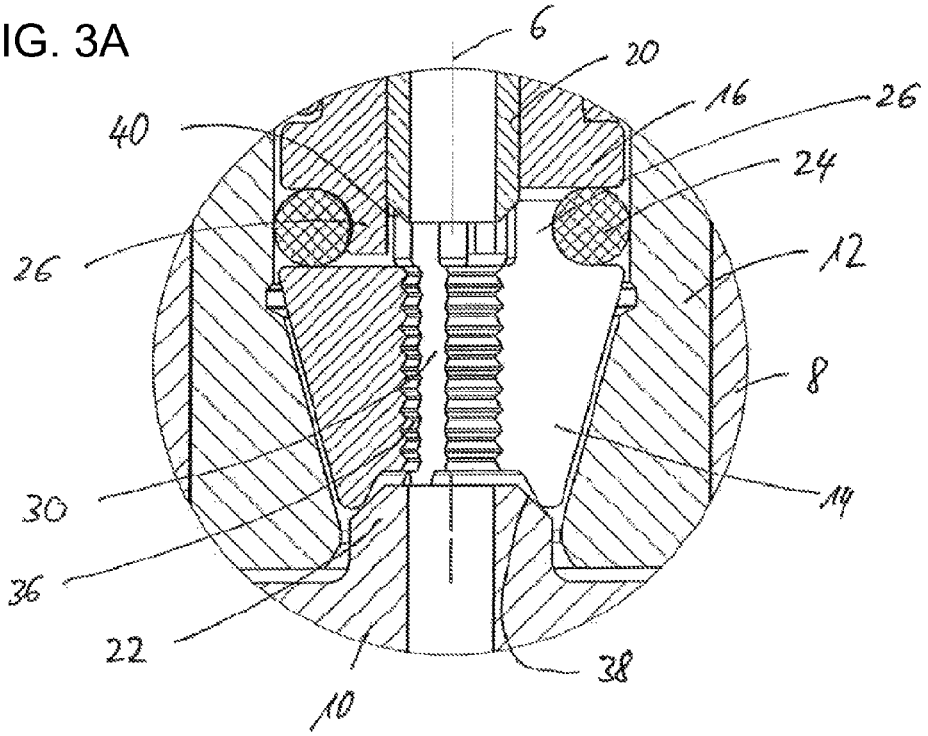
FIG. 3A shows an enlarged illustration of the region of the tension head indicated by X in FIG. 1A.

In the position illustrated in FIG. 1A and in particular in FIG. 3A, the clamping jaw sleeve 12 is in the front stroke position H1. In said position, the control sleeve 20 acts on the rear end 14B of the holding lugs 26 and expands the latter radially counter to the elastic holding force of the O-ring 24. At the same time, the pin 22 engages by way of a frustoconical end into an inner cone 42 at the front end 14A of the clamping jaws 14, such that the latter are additionally spread apart radially at their lower end. As a result, the clamping jaws 14 as a whole are spread, such that the receiving space 30 is formed approximately cylindrically with a larger diameter compared with the rivet mandrel 28.

Figure 3B:
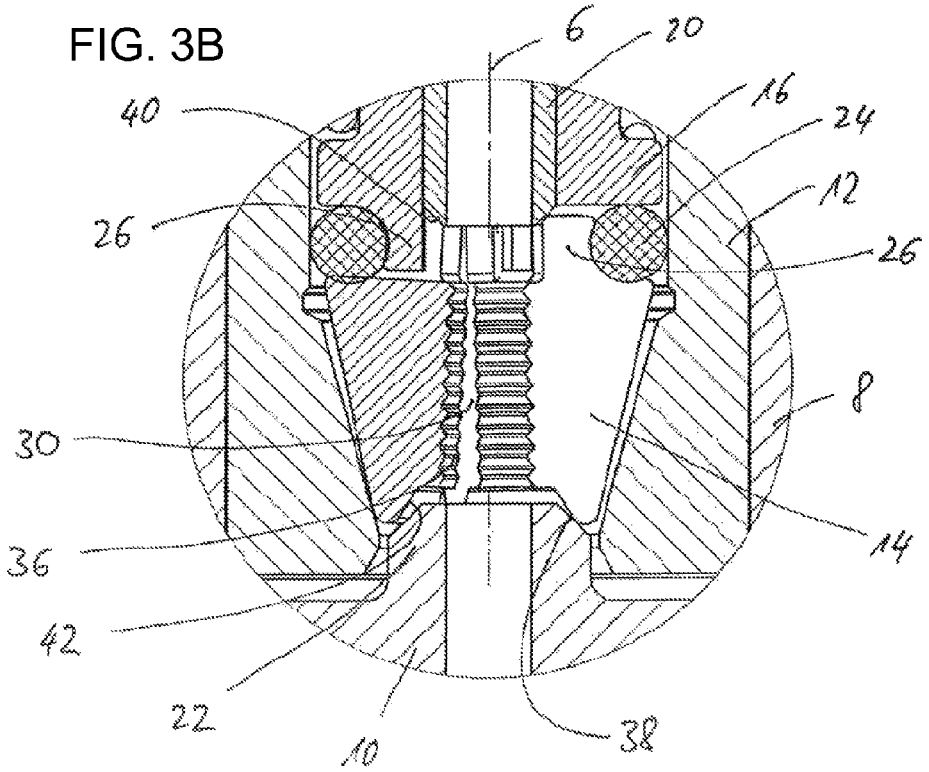
FIG. 3B shows an enlarged illustration of the region indicated by Y in FIG. 1B.

In the somewhat pulled-back rear stroke position H2, first of all only the control sleeve 20 is taken out of engagement with the clamping jaws 14, such that the clamping jaws 14 are then compressed at their rear end 14A by the elastic force of the O-ring 24. At the same time, the pin 22 is still engaged with the clamping jaws 14 such that the front end 14B continues to be expanded (FIG. 3B). As a result, the receiving space 30 is in the form of a funnel. This makes it easy to introduce the rivet mandrel 28 and at the same time to fix the latter in the clamping jaws.

The method for setting a blind rivet is as follows: in the basic position illustrated in FIG. 1B, a blind rivet having the rivet mandrel 28 is introduced, at a blind rivet receiving point, into the funnel-like receiving space 30 and is fixed there at the rear end 14B. Subsequently, the setting appliance moves from the blind rivet receiving point to a defined setting position over a pre-punched component. If required, the clamping jaw sleeve 12 can previously be pulled back in a controlled manner into a further stroke position such that the clamping jaws 14 already reliably clamp the rivet mandrel 28. After the blind rivet has been introduced into the pre-punched component, the clamping jaw sleeve is preferably pulled back further in a regulated manner until the rivet mandrel breaks off. After the blind rivet has been set, the clamping jaw sleeve moves into the front first stroke position H1 (FIG. 1A), such that both the front end 14A and the rear end 14B of the clamping jaws 14 are spread apart. The releasing position is taken up and the remaining residual mandrel can drop out of the receiving space 30 and is fed to a residual mandrel disposal unit. Subsequently, the tension head 2 returns to the basic position illustrated in FIG. 1B.

The individual components of the tension head 2 are illustrated once again in FIGS. 4 to 8. With reference to the exploded illustration in FIG. 4, the overall structure of the tension head can be seen. The individual parts are in each case in the form of a sleeve and are oriented concentrically with the center axis 6. The tension head 2 accordingly consists of the components mouthpiece sleeve 8, clamping jaw sleeve 12, clamping jaws 14, O-ring 24, pressure sleeve 16, compression spring 32, cap 18 and control sleeve 20. The elements clamping jaws 14, O-ring 24 and control sleeve 20 form a prefabricated assembly unit, as is illustrated in FIG. 5.

Figure 6:
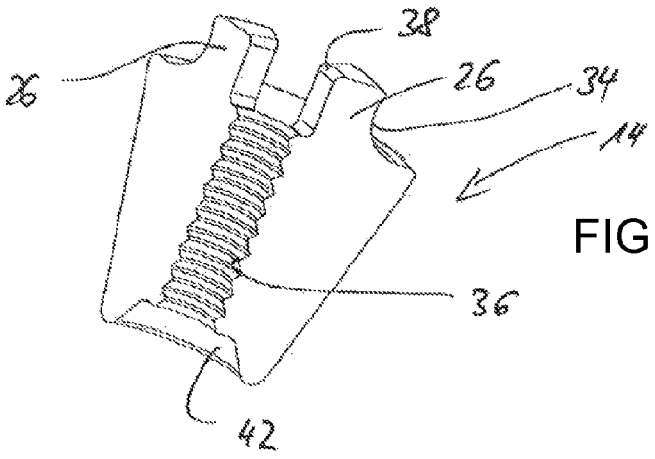
FIG. 6 shows a perspective illustration of a clamping jaw.
Figure 7:
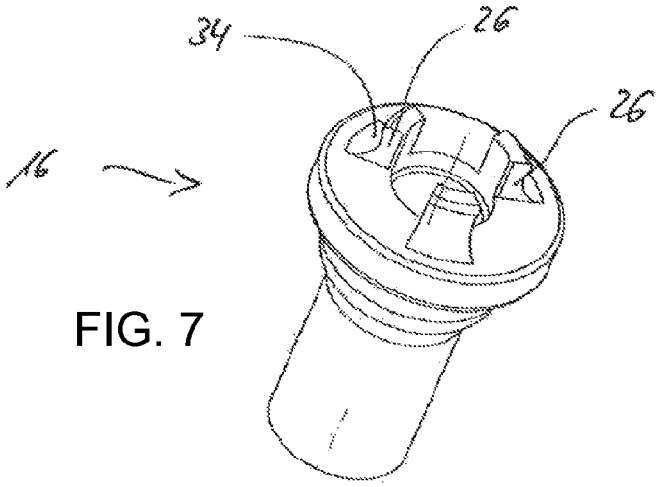
FIG. 7 shows a perspective illustration of a pressure sleeve.

With reference to FIGS. 6 and 7, in particular the holding lugs 26 on the clamping jaws 14 and on the pressure sleeve 16 can be seen. Each holding lug 26 has preferably two holding lugs 26 which are aligned with the side faces. Two mutually adjoining clamping jaws 14 therefore rest in each case against one another by way of their holding lugs 26. Between each pair of holding lugs 26, a corresponding holding lug 26 of the pressure sleeve 16 acts, said pressure sleeve 16 thus having a total of three holding lugs 26 on the end side.

The holding lugs 26 are each provided with a concavely curved receptacle 34 in which the O-ring 24 is accommodated. The receptacle 34 is configured in this case such that the O-ring 24 is held in a form-fitting manner (i.e., positively locked) in the axial direction 4.

FIG. 6 shows the configuration of the clamping jaws 14 which is approximately wedge-shaped in the axial direction 4 with the clamping ribs 36 formed on the inner side for reliably gripping the rivet mandrel 28. On the inner side, the holding lugs 26 have a conical slope 38 on the end side, the control sleeve 20 engaging in said slope 38 by way of an end-side cone 40.

Furthermore, the inner cone 42 of the clamping jaws 14, in which the pin 22 engages, can be seen at the front end 14A.

Figure 8:
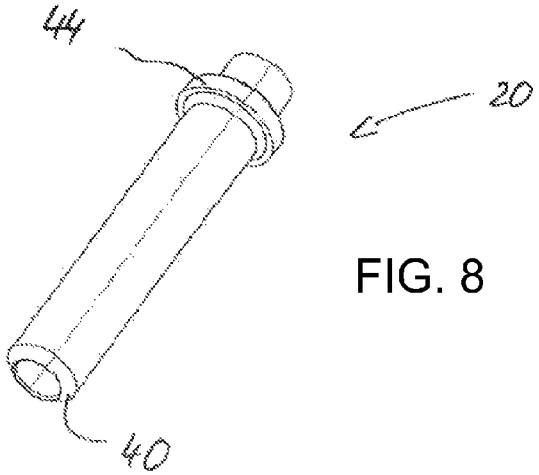
FIG. 8 shows a perspective illustration of a control sleeve.

Finally, FIG. 8 shows the configuration of the control sleeve 20 with its end-side cone 40 for spreading apart the clamping jaws 14 and its annular stop 44 formed at the rear end.

The invention claimed is:

1. A device for reversibly gripping a bolt-shaped element with a tension head extending in an axial direction, comprising:

a mouthpiece sleeve;

a clamping jaw sleeve movably mounted in said mouthpiece sleeve along the axial direction;

a plurality of segmented clamping jaws each extending in the axial direction from a front end to a rear end thereof, wherein said clamping jaws:

define a receiving space between one another for receiving the bolt-shaped element;

are disposed within said clamping jaw sleeve;

are configured to be displaced in a radial direction in order to reversibly grip the bolt-shaped element on occasion of an axial movement of said clamping jaw sleeve;

are displaceable with respect to one another independently of an actuation via said clamping jaw sleeve; and are furthermore held by an elastic holding element.

2. The device according to claim 1, wherein said elastic holding element is disposed at the rear end of said clamping jaws, holding said clamping jaws against one another in a hinge-like manner at the rear end.

3. The device according to claim 2, wherein said elastic holding element extends annularly around said clamping jaws.

4. The device according to claim 1, which comprises a pressure sleeve disposed to exert a pressure force counter to the axial direction on said clamping jaws, wherein said clamping jaws are fastened to said pressure sleeve via said elastic holding element.

5. The device according to claim 4, wherein said clamping jaws and said pressure sleeve have holding lugs arranged in an encircling manner alongside one another and surrounded by said elastic holding element.

6. The device according to claim 5, further comprising a control sleeve being guided through said pressure sleeve and having an annular stop at a rear end thereof to control a movement thereof.

7. The device according to claim 6, wherein said holding lugs have a concave abutment surface for said holding element such that a form fit takes place between said holding lugs and said holding element to hold said pressure sleeve and said clamping jaws against one another in the axial direction in a form fitting manner.

8. The device according to claim 5, wherein said holding lugs of the pressure sleeve and of said clamping jaws engage reciprocally with one another so that said holding lugs are located at common axial heights.

9. A device for reversibly gripping a bolt-shaped element with a tension head extending in an axial direction, comprising:

a mouthpiece sleeve;

a clamping jaw sleeve movably mounted in said mouthpiece sleeve along the axial direction;

a plurality of segmented clamping jaws each extending in the axial direction from a front end to a rear end thereof, wherein said clamping jaws:

define a receiving space between one another for receiving the bolt-shaped element;

are configured to hold a rivet mandrel of a blind rivet within said receiving space;

are disposed within said clamping jaw sleeve;

are configured to be displaced in a radial direction in order to reversibly grip the bolt-shaped element on occasion of an axial movement of said clamping jaw sleeve;

are displaceable with respect to one another independently of an actuation via said clamping jaw sleeve; and are furthermore held by an elastic holding element;

a stroke range being defined within which said clamping jaw sleeve is in an open position in which said clamping jaw sleeve is spaced apart from said clamping jaws, and wherein, within the stroke range, said clamping jaws are transferable from a fixing position into a releasing position by way of at least one control element, said clamping jaws being oriented obliquely with regard to the axial direction in the fixing position, to thereby form a funnel-like receiving space, and in the releasing position, said clamping jaws being spread in relation to one another at a rear end.

10. The device according to claim 9, wherein said clamping jaws are connected together in an articulated manner so that in the fixing position they are reciprocally spread apart from one another.

11. The device according to claim 9, wherein, said at least one control element moves said clamping jaws outward in the radial direction such that a funnel-like orientation of said clamping jaws in the fixing position is reversed.

12. The device according to claim 11, wherein said receiving space is substantially cylindrical in the releasing position with a larger diameter than the rivet mandrel.

13. The device according to claim 9, wherein said control element has an end-side cone configured for expanding said clamping jaws.

14. The device according to claim 9, wherein said control element is coupled to said clamping jaw sleeve such that, when said clamping jaw sleeve is axially displaced, said control element is forcibly carried along at least in one direction.

15. The device according to claim 9, wherein said control element is a first control element and wherein the front end of said clamping jaws is assigned a second control element, relative to which said clamping jaws are displaceable in the axial direction, and which is configured to spread said clamping jaws at the front end thereof.

16. The device according to claim 15, wherein said second control element is a stationary pin.

17. The device according to claim 15, wherein said second control element is configured to spread said clampimg jaws apart in the relaeasing position and in the fixing position.

18. A method for reversibly gripping a connecting element, which comprises: providing the device according to claim 9 and gripping the connecting element with the clamping jaws of the device.

19. The method according to claim 18, further comprising:

in a basic position defined by the fixing position, introducing a rivet mandrel into the funnel-like receiving space and fixing the rivet mandrel at the rear end of the clamping jaw;

pulling the clamping jaw sleeve back in a controlled manner until the rivet mandrel brakes off;

after the blind rivet has been set, moving the clamping jaw sleeve into a front first stroke position for spreading apart both the front end and the rear end of the clamping jaws for taking up the releasing position and dropping a residual mandrel out of the receiving space; and subsequently, returning the tension head to the basic position by pulling back into a rear stroke position and taking a control sleeve out of an engagement with the clamping jaws and compressing the clamping jaws at the rear end by elastic force of the elastic holding member.

20. The device according to claim 9, wherein said control element is displaceable in the axial direction relative to said clamping jaws and said control element acts on said rear end of said clamping jaws and spreads said clamping jaws.

* * * * *